US006343443B1

(12) United States Patent
Tylicki, Jr.

(10) Patent No.: US 6,343,443 B1
(45) Date of Patent: Feb. 5, 2002

(54) ABOVE GROUND SAFETY SHELTER

(76) Inventor: Henry F. Tylicki, Jr., 10091 Brandywine Dr., Huntsville, AL (US) 35803

( * ) Notice: Subject to any disclaimer, the term of this patent is extended or adjusted under 35 U.S.C. 154(b) by 0 days.

(21) Appl. No.: 09/397,815

(22) Filed: Sep. 17, 1999

(51) Int. Cl.[7] ..... E04H 1/00
(52) U.S. Cl. ..... 52/79.1; 52/432
(58) Field of Search ..... 52/79.1, 79.4, 52/79.6, 189, 190, 432

(56) References Cited

U.S. PATENT DOCUMENTS

| | | | | | |
|---|---|---|---|---|---|
| 242,924 | A | | 6/1881 | McKnight | |
| 995,089 | A | * | 6/1911 | Lewen | 52/432 X |
| 1,514,714 | A | * | 11/1924 | Needham et al. | 52/432 X |
| 3,300,943 | A | * | 1/1967 | Owens | 52/432 X |
| 3,693,308 | A | * | 9/1972 | Trezzini et al. | 52/432 X |
| 3,775,918 | A | * | 12/1973 | Fulton et al. | 52/79.4 |
| 3,848,377 | A | * | 11/1974 | Mori | 52/432 X |
| 4,038,793 | A | * | 8/1977 | Roca | 52/432 X |
| 4,126,972 | A | | 11/1978 | Silen | |
| 4,336,674 | A | | 6/1982 | Weber | |
| 4,501,098 | A | * | 2/1985 | Gregory | 52/79.1 |
| 4,539,780 | A | | 9/1985 | Rice | |
| 4,615,158 | A | | 10/1986 | Thomton | |
| 4,622,787 | A | * | 11/1986 | Scott | 52/79.1 X |
| 4,722,155 | A | * | 2/1988 | Ericsson | 52/79.1 |
| 4,741,140 | A | * | 5/1988 | Nakamura | 52/432 X |
| 4,955,166 | A | | 9/1990 | Qualline et al. | |
| 5,376,315 | A | | 12/1994 | Fricke | |
| 5,481,837 | A | | 1/1996 | Minks, Jr. | |
| 5,501,046 | A | * | 3/1996 | Hattingh et al. | 52/79.1 X |
| 5,769,011 | A | * | 6/1998 | Daniel | 52/79.1 X |
| 5,794,389 | A | | 8/1998 | Vysma | |
| 5,829,208 | A | | 11/1998 | Townley | |
| 5,921,043 | A | * | 7/1999 | McDonald | 52/79.1 X |

* cited by examiner

*Primary Examiner*—Peter M. Cuomo
*Assistant Examiner*—Stephen Vu
(74) *Attorney, Agent, or Firm*—Waddey & Patterson; John C. Garvin, Jr.

(57) ABSTRACT

An above ground shelter that provides protection against dangerous events including micro-bursts, tornadoes, hurricanes, earthquakes, and personal attack. The shelter is a low profile standalone structure that consists of top, bottom, and side walls and an access door. The shelter is specifically designed for installation in the crawl space below mobile homes, to be entered through an access hatch interior to the mobile home. The shelter is also designed to serve as an entry platform to mobile homes, and as such is configurable with steps, railings, canopies, and handicap access ramps. The shelter's exterior geometric shape was specifically developed to provide optimal deflection of air-born debris, and to provide aerodynamic down force in high velocity winds. In addition, the shelter geometry allows transport and installation by existing commercial equipment. The shelter is of sufficient weight that, in combination with down force aero loads, does not require mandatory attachment to the ground.

12 Claims, 8 Drawing Sheets

ABOVE GROUND SAFETY SHELTER

FIELD OF THE INVENTION

This invention relates to an above ground safety shelter that provides protection from dangerous events such as microbursts, tornadoes, hurricanes, earthquakes, and personal attack. While the shelter is suitable for general use, it is specifically configured for use in conjunction with manufactured housing and mobile homes.

BACKGROUND OF THE INVENTION

There are numerous areas of the United States and other parts of the world that are periodically exposed to tornadoes, storms, and the like, especially during the spring and fall months. Within the United States, tornadoes can occur in any state, but are more frequent in the Midwest, Southeast, and Southwest. The states of Alabama, Arkansas, Florida, Georgia, Illinois, Indiana, Iowa, Kansas, Louisiana, Mississippi, Missouri, Nebraska, Oklahoma, South Dakota, and Texas are at the greatest risk.

Mobile and manufactured homes are especially susceptible to damage from severe thunderstorms, tornadoes, hurricanes, and the like due to their light weight and fragile construction and inadequate or complete absence of anchoring mechanisms. Occupants of mobile and manufactured homes generally have no means of protection from an approaching tornado or storm. While highly desirable, mobile and manufactured homes are generally provided with little, if any, protection against high winds and storms by the owners of the lots upon which the homes are placed.

While heretofore, there have been several safety shelters which were intended for association with mobile or manufactured homes, they have encountered limited success for many reasons and deficiencies. Applicant is aware of only the following U.S. patents which are exemplary of the known prior art safety shelters intended for use with mobile or manufactured homes: U.S. Pat. Nos. 4,615,158 to Thornton and 5,481,837 to Minks, Jr. Applicant is unaware of any standalone above ground safety shelter.

U.S. Pat. No. 4,615,158 to Thornton discloses a safety shelter in communication with the interior of a mobile home. The shelter is an underground enclosure defined by an annular sidewall, a top, and a bottom. The top of the enclosure has an entrance and egress passageway in communication with both the mobile home and underground enclosure. The passageway is surrounded by a flexible and moveable sidewall. An associated stepladder is provided for allowing convenient ingress and egress. When the mobile home is moved, the passageway sidewall is removed, and the shelter sealed until a new mobile home is moved into place. The invention disclosed in Thornton requires a significant modification to the mobile home. Additionally, since the underground enclosure is anchored in concrete, the placement of another mobile home for communication with the underground enclosure would require precise location of the mobile home with respect to the underground enclosure and require further modifications to the newly placed mobile home.

U.S. Pat. No. 5,481,437 to Minks, Jr. discloses the combination of a mobile home and a safety shelter. The safety shelter is generally rectangular in configuration and includes four side walls, a bottom wall, a top wall which also serves as a floor of the stoop for the front entrance of the mobile home, and an access door in one of the side walls. A set of steps is provided to enable a person to easily move between the ground and the floor of the stoop. The safety shelter is partially buried below the ground level and extends partially above the ground level.

Respecting the present invention, key constraints driving the creative process were time spent in shelter per event, size of shelter, level of protection provided, low cost, manufacturability, retro fit to an existing dwelling, access from inside a dwelling, ease of installation, and transportability.

The estimated time spent in the shelter per tornadic event was used to set the scope of the invention. Given current storm cell tracking and weather warning technology, and typical reluctance to seek shelter without a visual or audible cue, actual time in the shelter need only be on the order of a few minutes. This short in-shelter time interval makes a geometrically small shelter tolerable.

The acceptability of a small shelter drives the level of protection provided and economics into desirable and marketable positions. Essentially, as the size of the structure decreases, the cost factors decrease, and most importantly—the protection to cost ratio increases significantly. In other words, a smaller structure can provide a much larger level of protection than a larger structure, given the constraint that they cost the same.

The need for quick access led to the development of the concept of having an access hatch internal to the dwelling or place of occupancy. The prospect of providing additional functionality led to the development of steps, hand rails, ramps, and canopies which allow the invention to dually serve as entry platform to a dwelling or place of occupancy.

Finally, successful sales and marketing demand low cost. Meeting this requirement is achieved by using low cost materials, existing manufacturing production line capabilities, quantity buying power, distributed manufacturing systems, and maintaining compatibility with existing transportation and handling equipment.

SUMMARY OF THE INVENTION

In accordance with the preferred embodiment of the present invention, an improved above ground safety shelter is provided for safely housing and protecting one or more people during stormy and tornadic weather. While the preferred embodiment of the invention is envisioned for use with mobile and manufactured homes, it can be used as a standalone safety shelter positioned some distance from another structure.

The preferred embodiment of the safety shelter of the present invention generally comprises an above ground enclosure including four trapezoid-shaped side walls, a bottom or floor, a top wall which also served as a front porch or stoop extending generally horizontally away from the entranceway or door of a mobile home, and means for accessing the enclosed area defined by the safety shelter. The shelter's exterior geometric shape with sloped side walls provides optimal deflection of strong winds and blown debris and also provides an aerodynamic down force for the shelter. The shelter is of sufficient weight that, in combination with the aerodynamic down force applied to the shelter, does not require mandatory anchoring to the ground. The lack of rigid ground anchoring increases the shelter's ability to dissipate and/or minimize absorption of collision impact energy via very small displacements relative to the size of the shelter.

Accordingly, it is an object of the present invention to provide an above ground safety shelter for safely housing one or more occupants.

It is a further object of the present invention to provide an above ground safety shelter having sloped or curvilinear side walls for deflecting strong winds and blown debris and providing aerodynamic down forces for positional stability.

It is yet another object of the present invention to provide a safety shelter for use with mobile or manufactured homes.

It is still another object of the present invention to provide a safety shelter which is self-contained and does not depend upon the mobile home for any part of its structure and in certain embodiments not occupy more space than a mobile home without a safety shelter.

DESCRIPTION OF THE PREFERRED EMBODIMENTS

Figure 1:
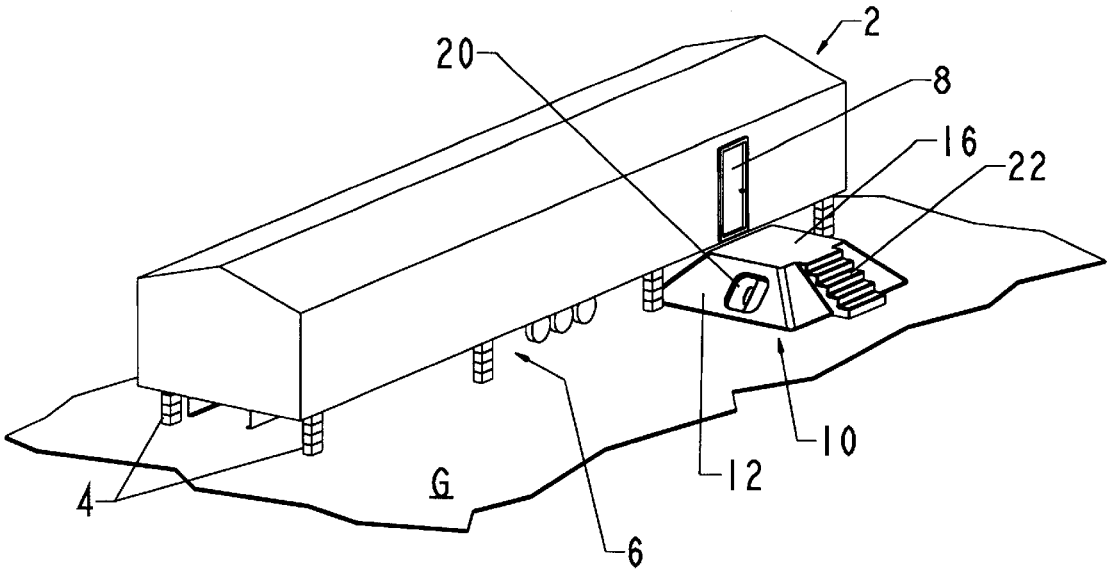
FIG. 1 is a perspective view of the preferred embodiment of the safety shelter of the invention which also serves as a front stoop for a manufactured or mobile home.

Thus, although there have been described particular embodiments of the present invention of a new and useful ABOVE GROUND SAFETY SHELTER, it is not intended that such references be construed as limitations upon the scope of this invention except as set forth in the following claims.

Referring now to the drawings, reference numeral 2 generally designates a manufactured or mobile home supported from the ground G by a plurality of columns of stacked concrete blocks 4 and having a crawl space 6 thereunder, and a front entranceway (door) 8 to the home 2. While a plurality of stacked concrete blocks 4 are shown for supporting mobile or manufactured home 2, it is apparent that any other conventional means (e.g., concrete foundation, piled dirt, etc.) could be employed to support the home 2.

As best seen in FIG. 1, a safety shelter 10 of the preferred embodiment is associated with the home 2 and its entranceway or door 8. As best seen in FIGS. 2–5, safety shelter 10 generally includes four trapezoid-shaped side walls 12, a generally rectangular floor or bottom wall 14, a generally rectangular roof or top wall 16, a plurality of vertical posts 18 connecting the floor 14 to the roof 16, an access door 20 in one of the trapezoid-shaped side walls 12, and a set of steps 22. While vertical posts 18 are shown for connecting the floor 14 to roof 16, it is apparent that these posts may be omitted as not necessary. Each trapezoid-shaped side wall 12 includes a top edge 24, a bottom edge 26, and two sloped side edges 28. Each side edge 28 of trapezoid-shaped side wall 12 is secured to or made integral with the side edge 28 of an adjacent side wall 12. As shown, the floor 14 and roof 16 are square or rectangular and each includes four side edges (not numbered). Each side edge of floor 14 is secured to or made integral with a respective bottom edge 26 of a respective trapezoid-shaped side wall 12. Each side edge of roof 16 is secured to or made integral with a respective top edge 24 of a respective trapezoid-shaped side wall 12. As best shown in FIGS. 2–5, one side wall 12 has an opening 30 therein which can be opened or closed by moving the door 20 which is mounted horizontally in a pair of parallel tracks or rails 32. The access door 20 has a pair of handles 34 and 36 secured thereto on opposite sides of the door 20 for grasping to open and close the door 20. As best seen in FIG. 1, the steps 22 allow people to ascend to and descend from the roof 16 which functions also as a porch or stoop leading to and from the entranceway 8 of mobile or manufactured home 2.

Figure 2:
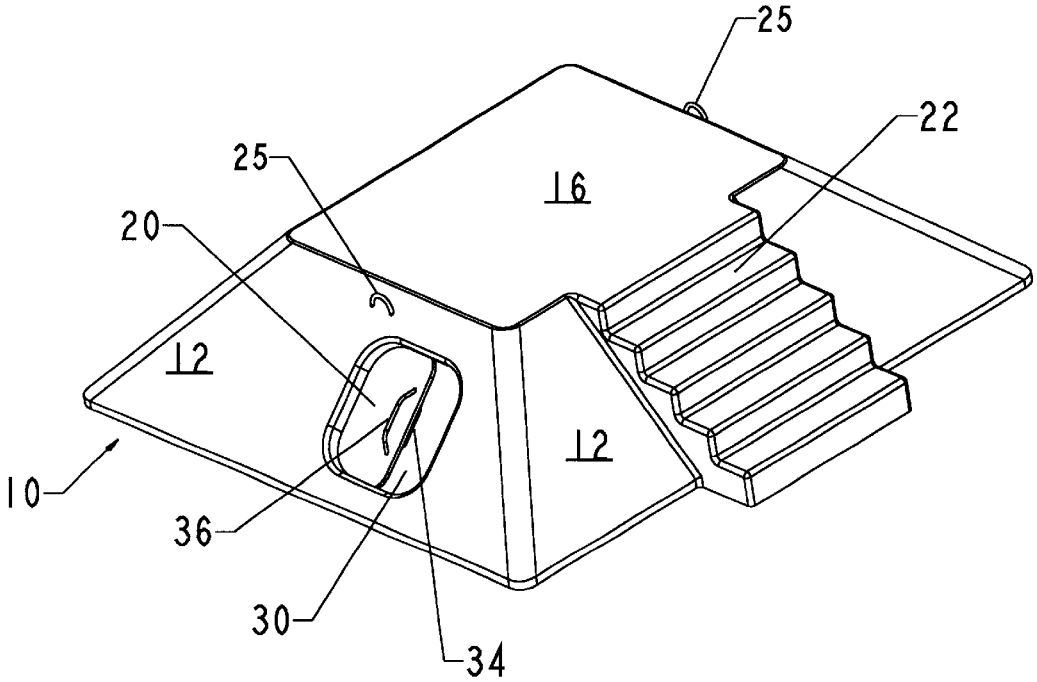
FIG. 2 is a perspective view of the preferred embodiment of the present invention with its door and entrance being in a side wall and shown independently of a manufactured or mobile home.
Figure 3:
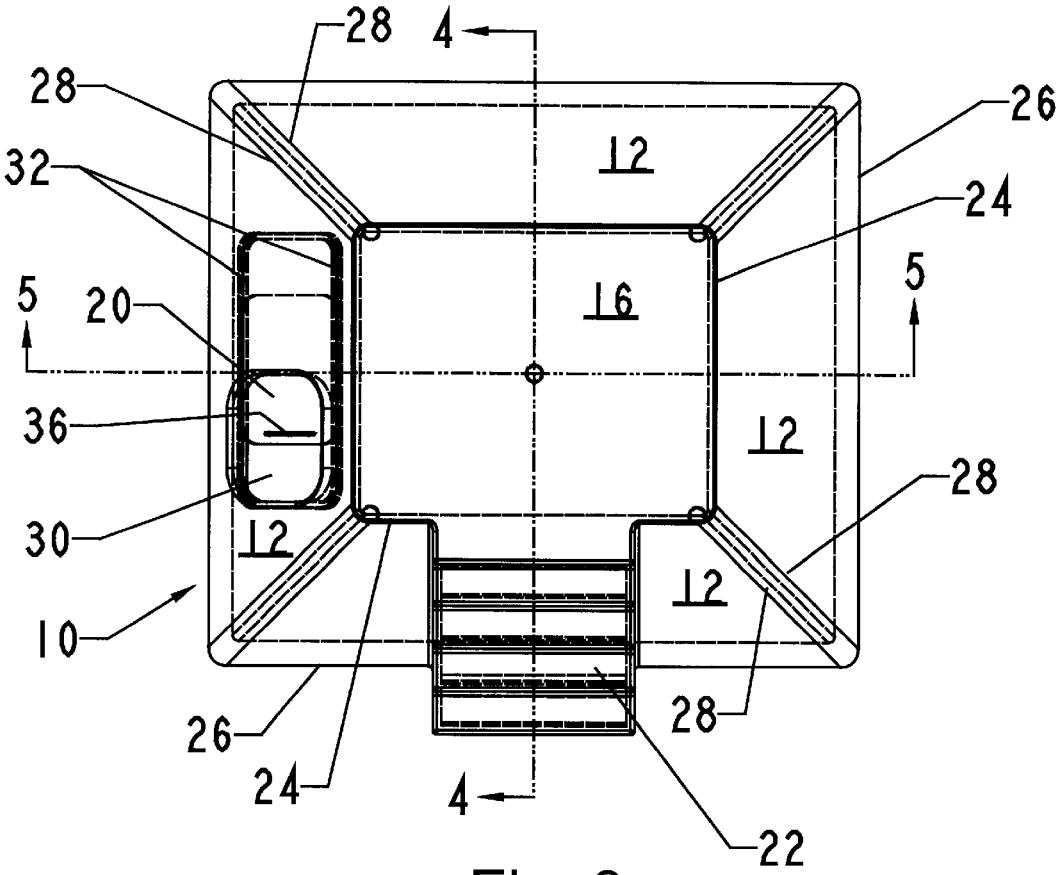
FIG. 3 is a top plan view of the preferred embodiment of the present invention as depicted in FIG. 2.
Figure 4:
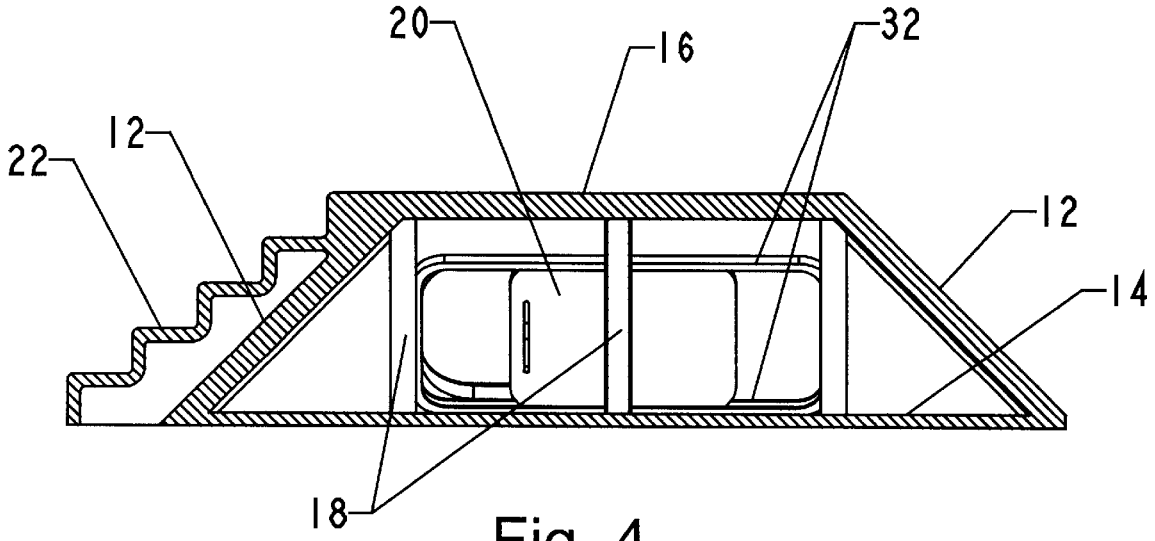
FIG. 4 is a cross-sectional view of the preferred embodiment of the safety shelter of the present invention taken along line 4—4 of FIG. 3.
Figure 5:
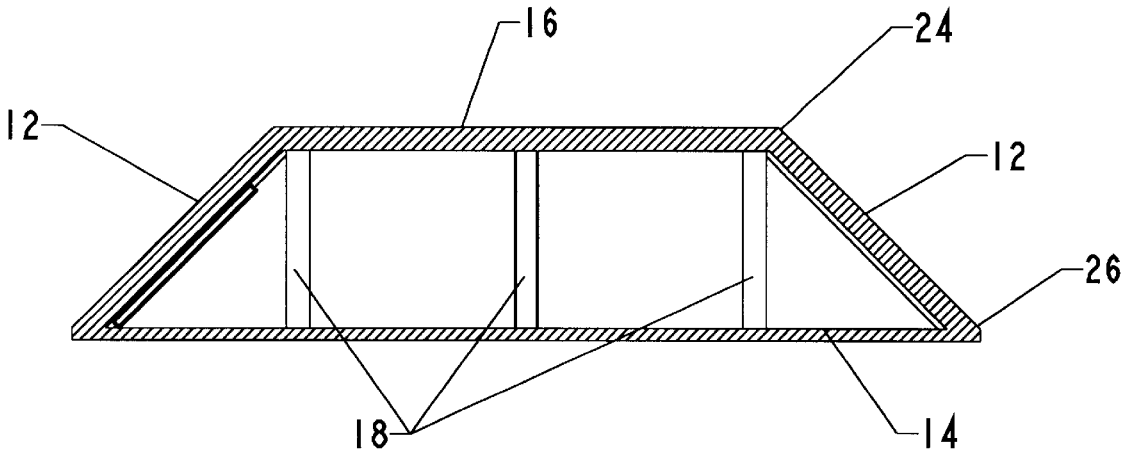
FIG. 5 is a cross-sectional view of the preferred embodiment of the safety shelter of the present invention taken along line 5—5 of FIG. 3.

As best seen in FIG. 2, a steel rebar is bent into eyes 25 and embedded or anchored in two opposed side walls 12 adjacent their upper edge 24 to be engaged by a cable, strap, or rope suspended from the boom or arm of a backhoe or other equipment (not shown) for moving or positioning shelter 10.

As best seen in FIGS. 2–5, the bottom edge 26 of each trapezoid-shaped side wall 12 and an adjacent outer edge (not numbered) of floor or bottom wall 14 form an inner acute angle which causes the juncture of a side wall 12 and the floor or bottom wall 14 to dig into the ground and resist movement of the shelter 10 when the shelter 10 is subject to high winds or is hit by blown debris.

Figure 6:
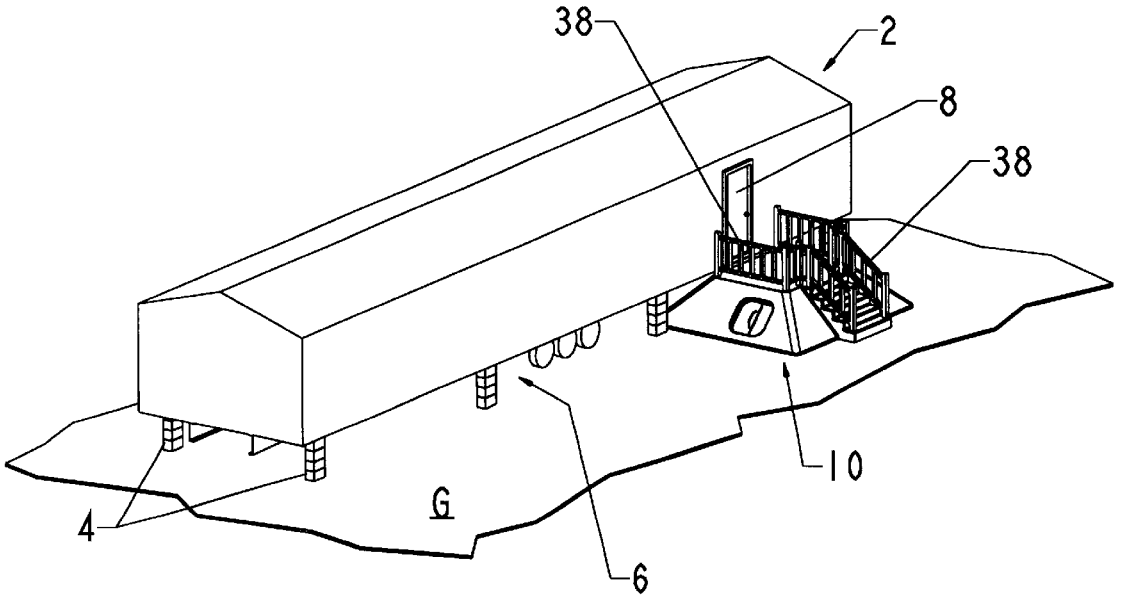
FIG. 6 is a perspective view of the preferred embodiment of the present invention having handrails and steps associated therewith.

As best seen in FIG. 6, hand rails 38 may be provided on each side of the steps 22 and roof 16 for safety purposes.

Figure 7:
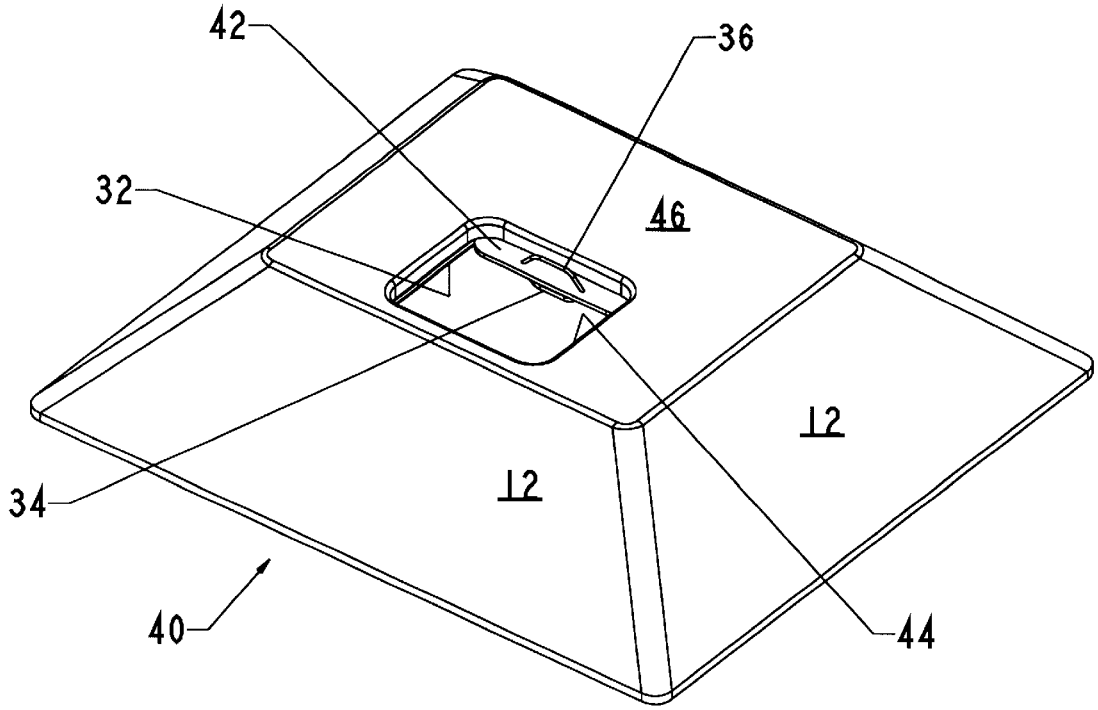
FIG. 7 is a perspective view of a second embodiment of the present invention having its door or entrance in the roof or top wall and shown independently of a manufactured or mobile home and without steps.
Figure 8:
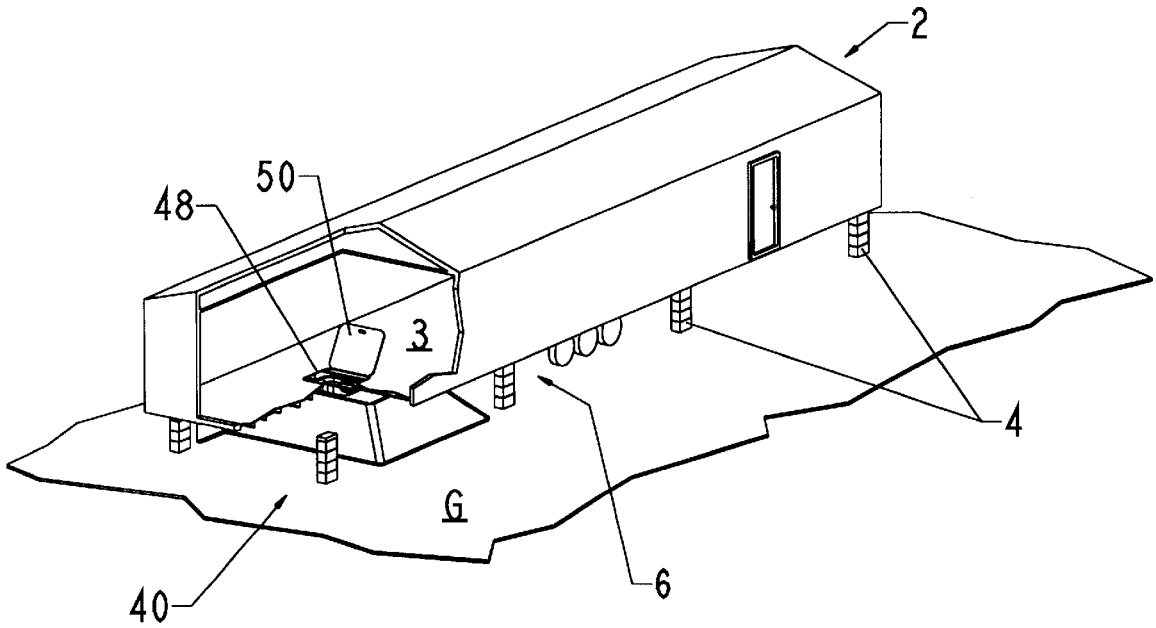
FIG. 8 is a perspective partially broken-away view of the embodiment of the safety shelter depicted in FIG. 7 as installed in the crawl space below a manufactured or mobile home, which permits ingress and egress through an access hatch built in the floor of a manufactured or mobile home.

As best seen in FIG. 7, reference numeral 40 generally designates a second embodiment of the safety shelter of the present invention. Safety shelter 40 differs from safety shelter 10 primarily in that it has no steps, its access door 42 is mounted within an opening 44 in the roof or top wall 46, and there is no vertical post 18 connecting the central portion of the roof and floor of the safety shelter. As best seen in FIG. 8, safety shelter 40 is primarily intended to be placed in the typical crawl space 6 under the mobile or manufactured home 2 at a location where the access door 42 is directly under an opening 48 in the floor 3 of the home 2. A hinged trap door 50 is provided in floor 3 of home 2 to gain access to access door 50 of safety shelter 40.

Figure 9:
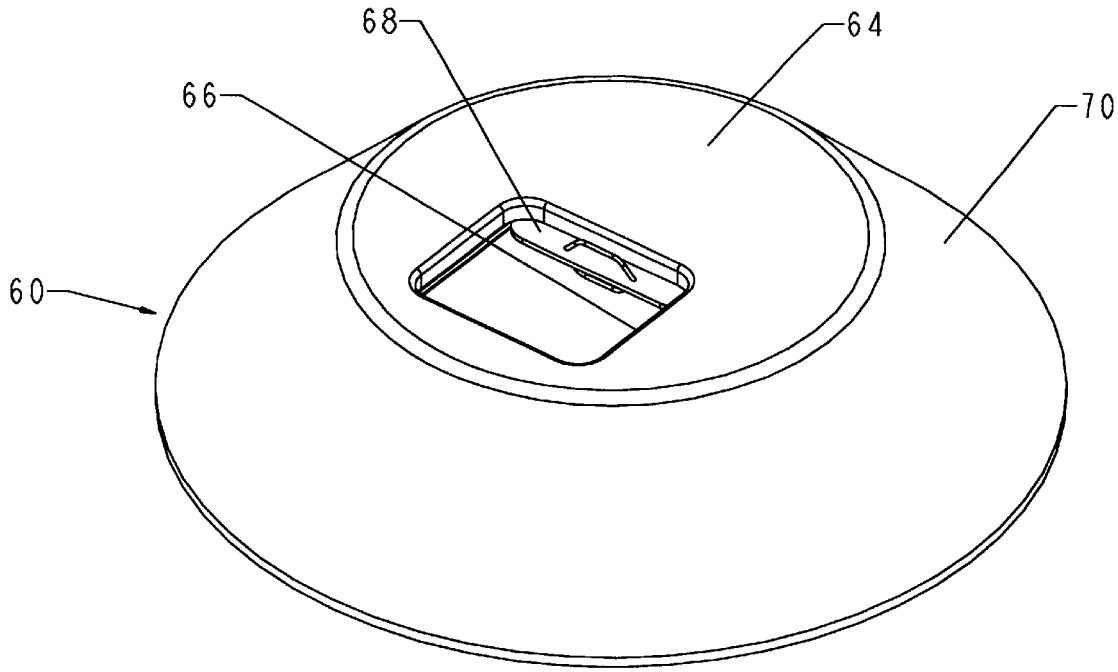
FIG. 9 is a perspective view of a third embodiment of the safety shelter of the present invention that incorporates a circular side wall.
Figure 10:
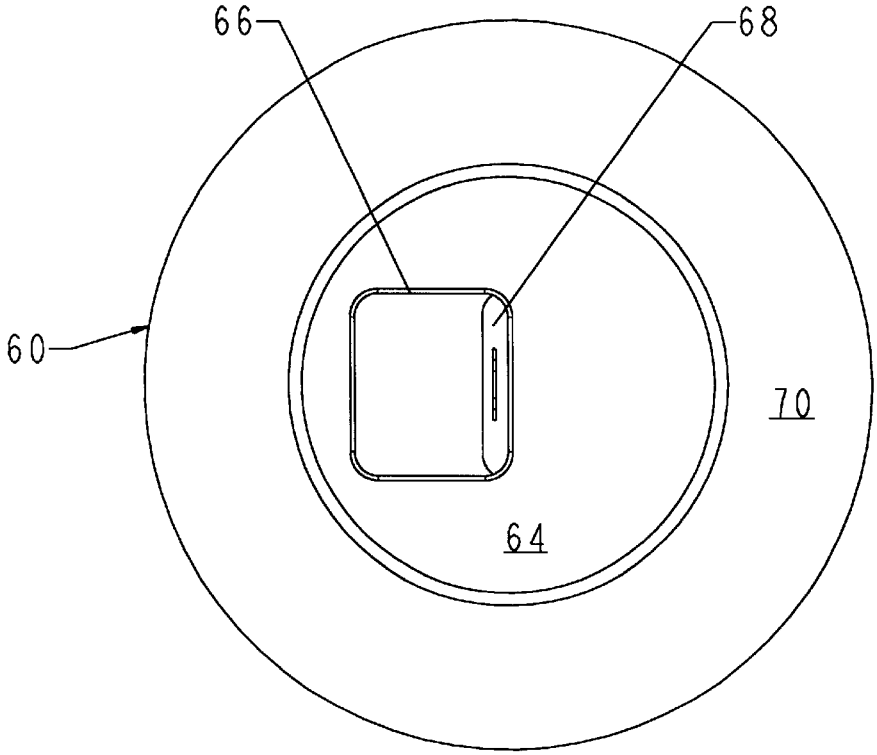
FIG. 10 is a top plan view of the third embodiment of the safety shelter of the present invention depicted in FIG. 9.
Figure 11:
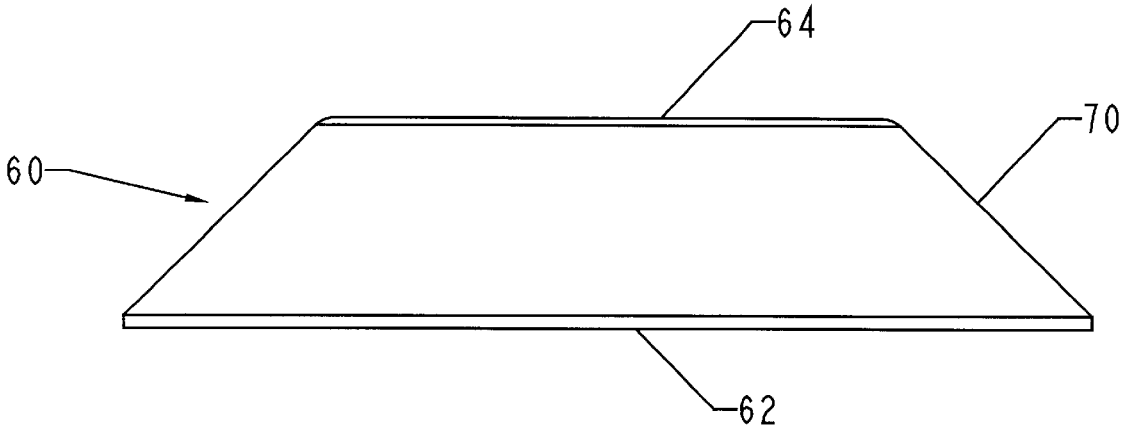
FIG. 11 is a side elevational view of the third embodiment of the safety shelter depicted in FIGS. 9 and 10.

As best seen in FIGS. 9–11, reference numeral 60 generally designates a third embodiment of the safety shelter of the present invention. Safety shelter 60 differs from shelter 10 and 40 primarily in that it is configured as a truncated cone having a round floor or bottom-wall 62, a round top wall or roof 64, and a conical side wall 70 connecting the floor 62 and roof 64. As shown, the access door 68 is mounted within an opening 66 in the roof 64.

Figure 12:
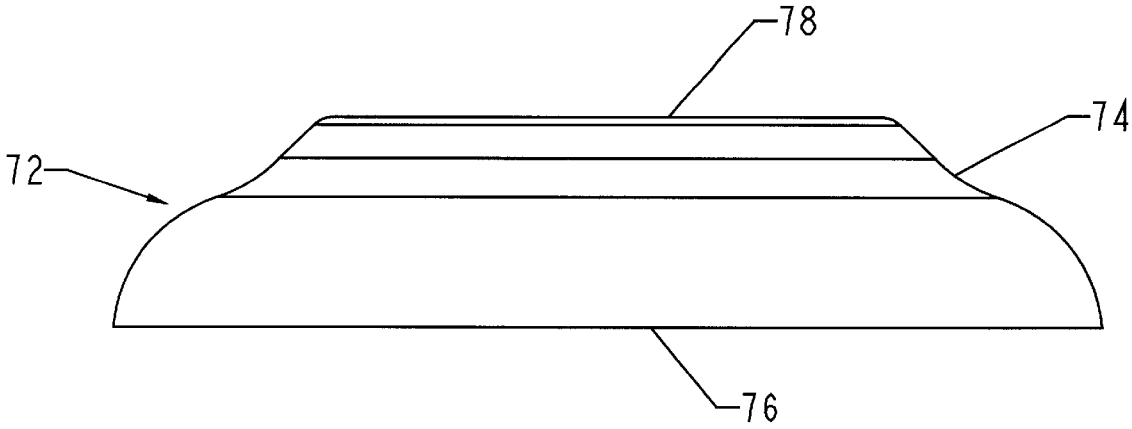
FIG. 12 is a side elevational, partially broken-away, view of a fourth embodiment of the safety shelter of the present invention that incorporates a curvilinear side wall.

As best seen in FIG. 12, reference numeral 72 generally designates a fourth embodiment of the safety shelter of the present invention. Safety shelter 72 differs from shelter 60 primarily in that its sloped side wall 74 between floor 76 and roof 78 is curvilinear.

Figure 13:
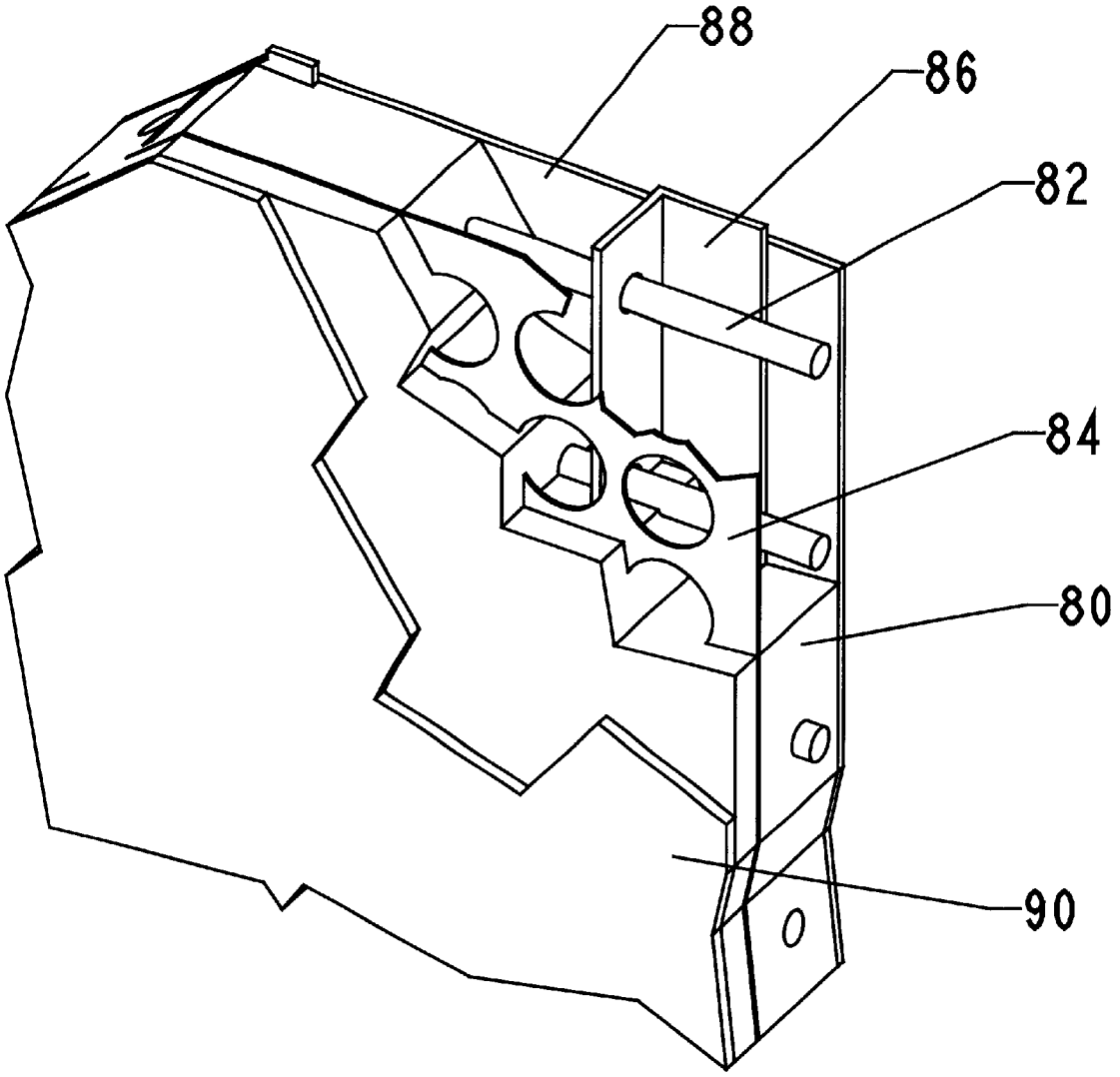
FIG. 13 is a perspective, partially broken-away, and in-section view showing the general details of construction of the side walls, roof, and floor for several embodiments of the present invention.

The side walls, bottom walls, and top walls of the safety shelter can be made with any acceptable and suitable materials. As depicted in FIG. 13, each such wall might be comprised of a reinforced core structure including concrete 80; steel rebars 82; suspended reinforcement sheeting 84; angle iron 86; an outer skin 88 for energy absorption and debris deflection made of a composite such as alloys or viscoelastic materials; and an inner skin 90 of a composite such as alloys or viscoelastic materials.

Figure 14:
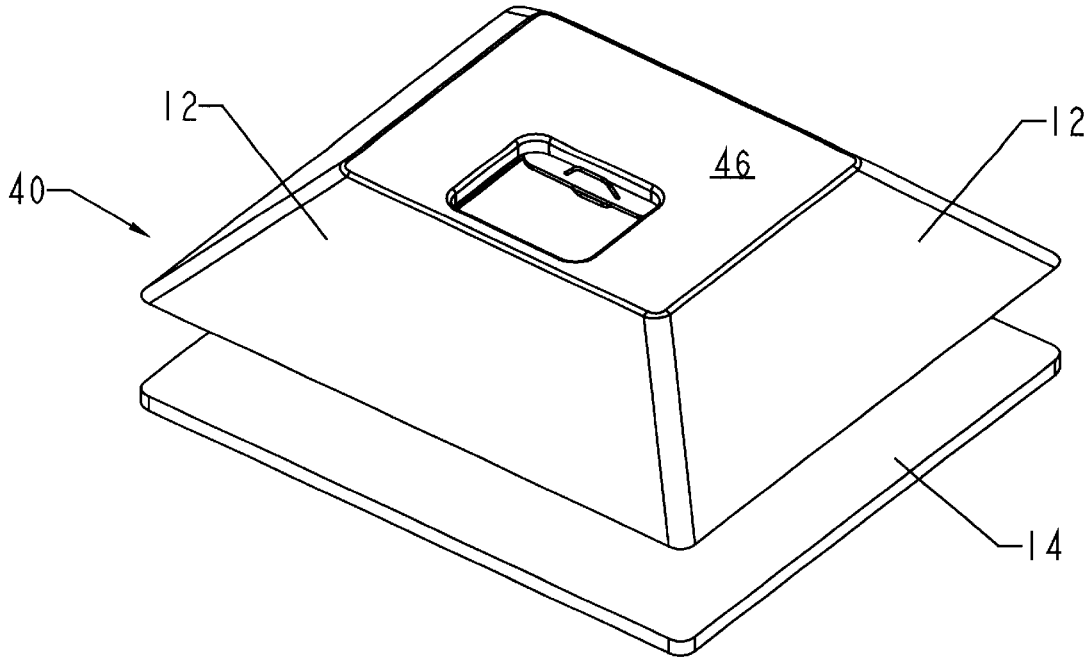
FIG. 14 is an exploded perspective view of the embodiment of the invention depicted in FIGS. 7 and 8 to generally show the floor of the shelter separated from the side walls and roof of the shelter.
Figure 15:
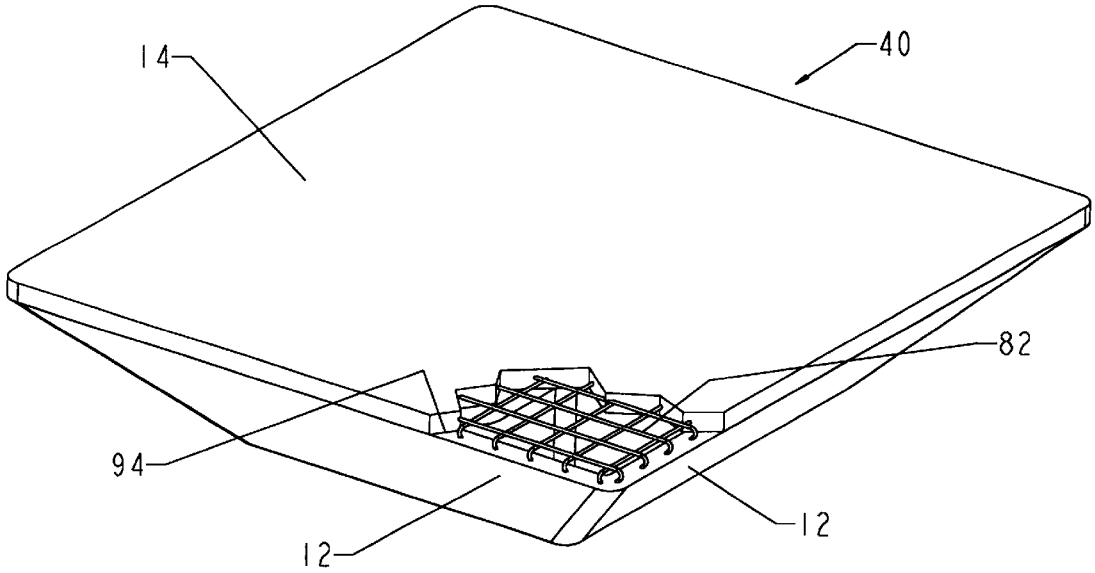
FIG. 15 is an inverted, perspective, partially broken-away, view of the embodiment of the invention depicted in FIGS. 7, 8 and 14 and showing one way to secure the side walls of the shelter to its floor.

As best seen in FIGS. 14 and 15, one of the possible ways of making the safety shelter of the present invention might be as follows: the top wall or roof 46 and the side walls 12 may be molded in one piece with the mold being removed through the large bottom opening defined by the bottom edges 26 of side walls 12. After the side walls 12 and the top wall 46 are cured, rebars and the like extending from the bottom edge 26 of side walls 12 are welded to rebars and the like which are to be incorporated as a part of the floor 12. The floor or bottom wall 14 is next poured in a mold for receiving wet concrete and the side walls 12 connected to the top wall 46 is then lowered into the mold and the concrete is allowed to harden and cure to thus assemble the shelter. While the above description constitutes preferred embodiments of the present invention, it will be appreciated that the invention is susceptible to modification, variation, and change without departing from the proper scope and fair meaning of the accompanying claims. For example, air ventilating means could be provided in each embodiment of the invention. Further, internal water draining means could be provided in each embodiment of the invention. Still further, hinged access doors could be used in lieu of the sliding access doors. Furthermore, the steel rebars which are bent to form the eyes 25 could be anchored in top wall or roof 16 in lieu of the side walls 12. As is further readily apparent, means for anchoring each embodiment of the invention to the ground could be provided if such was deemed necessary. The anchoring means would preferably be flexible to allow minimum movement of the safety shelter. Still further, as is readily apparent, the safety shelter of the present invention could have any member of side walls rather than one or four side walls.

What is claimed is:

1. An above ground safety shelter defining an enclosed area for receiving and protecting at least one person from dangerous events including tornadoes, hurricanes, high winds and airborne debris, said shelter comprising:

at least one upwardly inclined wall having an upper distal end and a lower distal end, said inclined wall having an outer surface and including reinforcement means including concrete, a plurality of steel bars, an outer skin, and an inner skin for absorbing and dissipating impacting energy as a means of increasing penetration resistance;

a roof disposed at said upper distal end of said at least one inclined wall;

a floor disposed at said lower distal end of said at least one inclined wall; and at least one door for accessing the interior of said enclosed area;

said at least one inclined wall being monolithic and being geometrically shaped for deflecting wind blown debris to reduce energy absorption by said at least one inclined wall from any impacts of windblown debris;

said at least one inclined wall being further aerodynamically shaped to develop down forces responsive to impact by the high velocity winds, said down forces disposed for increasing the structural stability of the shelter by enhancing the forces necessary to keep the shelter on the ground.

2. The above ground safety shelter of claim 1 wherein said at least one door for accessing the interior of said enclosed area is mounted within said at least one upwardly inclined wall.

3. The above ground safety shelter of claim 2 wherein said at least one door has opposed faces and a handle secured to each said opposed face.

4. The above ground safety shelter of claim 1 wherein said at least one door for accessing the interior of said enclosed area is mounted within said roof.

5. The above ground safety shelter of claim 4 wherein said at least one door has opposed faces and a handle secured to each of said opposed faces.

6. The above ground safety shelter of claim 1 wherein said at least one inclined wall is conical in shape.

7. The above ground safety shelter of claim 1 wherein said at least one inclined wall is curvilinear in shape.

8. An above ground safety shelter defining an enclosed area for receiving and safeguarding at least one person from dangerous events including tornadoes and hurricanes and airborne debris, said shelter comprising:

at least one upwardly inclined surface having an upper distal end and a lower distal end, said inclined surface includes steel reinforced concrete, an outer skin, internally suspended reinforcement sheeting, and an inner skin specifically for absorbing and dissipating impact energy as a means of increasing penetration resistance;

a roof disposed as said upper distal end of said inclined surface;

a floor disposed at said lower distal end of said at least one inclined surface; and at least one door for accessing the interior of said enclosed area;

said at least one inclined surface being geometrically shaped for deflecting windblown debris to reduce energy absorption by said at least one inclined surface from any impacts of windblown debris;

said at least one inclined surface being further aerodynamically shaped to develop down force in high velocity winds which assists in keeping the shelter on the ground.

9. The above ground safety shelter of claim 8 wherein said at least one door for accessing the interior of said enclosed area is mounted within said at least one upwardly inclined surface.

10. The above ground safety shelter of claim 8 wherein said at least one door for accessing the interior of said enclosed area is mounted within said roof.

11. The above ground safety shelter of claim 8 wherein said at least one inclined surface is conical in shape.

12. The above ground safety shelter of claim 8 wherein said at least one inclined surface is curvilinear in shape.

* * * * *